US005464967A

United States Patent [19]

Gong

[11] Patent Number: 5,464,967

[45] Date of Patent: Nov. 7, 1995

[54] METHOD FOR THAWING FOOD IN MICROWAVE OVEN

[75] Inventor: Chun S. Gong, Kyungsangnam-Do, Rep. of Korea

[73] Assignee: Goldstar Co., Ltd., Seoul, Rep. of Korea

[21] Appl. No.: 309,189

[22] Filed: Sep. 20, 1994

[30] Foreign Application Priority Data

Sep. 28, 1993 [KR] Rep. of Korea ..... 20285/1993

[51] Int. Cl.[6] ..... H05B 6/68

[52] U.S. Cl. ..... 219/703; 219/707; 426/241; 426/523

[58] Field of Search ..... 219/703, 707, 219/719, 705; 426/241, 523; 99/DIG. 14

[56] References Cited

U.S. PATENT DOCUMENTS

| | | | |
|---|---|---|---|
| 4,097,707 | 6/1978 | Kobayashi et al. | 219/707 |
| 4,230,731 | 10/1980 | Tyler . | |
| 4,336,433 | 6/1982 | Yokozeki | 219/707 |
| 4,376,131 | 3/1983 | Mori et al. | 219/707 |
| 4,379,964 | 4/1983 | Kanazawa et al. | 219/707 |
| 4,553,011 | 11/1985 | Nakata et al. . | |
| 4,692,597 | 9/1987 | Tsuda et al. | 219/703 |
| 4,791,263 | 12/1988 | Groeschel, Jr. . | |
| 4,841,111 | 6/1989 | Kokkeler et al. | 219/703 |
| 5,015,812 | 5/1991 | Kasai et al. | 219/707 |
| 5,155,339 | 10/1992 | An | 219/707 |

FOREIGN PATENT DOCUMENTS

| | | |
|---|---|---|
| 0024798 | 3/1981 | European Pat. Off. . |
| 0281263 | 9/1988 | European Pat. Off. . |
| 0360341 | 3/1990 | European Pat. Off. . |
| 2204427 | 11/1988 | United Kingdom . |
| 2206425 | 1/1989 | United Kingdom . |

*Primary Examiner*—Philip H. Leung

[57] ABSTRACT

A method of thawing a food in a microwave oven, capable of achieving an optimum thawing of the food by temporarily stopping the heating of the food for a predetermined time after completion of an initial heating of the food, determining whether an additional heating of the food should be executed, on the basis of a variation of an output signal generated from a gas sensor, during the temporary stop interval, and calculating a time for the additional heating, during the temporary stop interval.

6 Claims, 8 Drawing Sheets

METHOD FOR THAWING FOOD IN MICROWAVE OVEN

BACKGROUND OF THE INVENTION

1. Field of the Invention

The present invention relates to a method for thawing food in a microwave oven, and more particularly to a food thawing method capable of effectively thawing a small amount of food.

2. Description of the Background Art

Referring to FIG. 1, there is shown a thawing device equipped in a microwave oven. As shown in FIG. 1, the thawing device includes a heating chamber 1 for heating a food 2 disposed therein. A turntable 3 is rotatably disposed in the heating chamber 1. The turntable 3 supports the food 2 thereon. Thawing device also includes a turntable motor 4 for rotating the turntable 3 and an exhaust port 5 for exhausting water vapor and gas generated in the heating chamber 1. A gas sensor 6 is disposed near the exhaust port 5 so as to sense water vapor and gas exhausted through the exhaust port 5. The thawing device further includes a microcomputer 7 for calculating a thawing time for the food 2 based on an output signal from the gas sensor 6 and controlling various parts of the microwave oven, a display unit 8 for displaying the thawing time calculated by the microcomputer 7 and other information such as cooking time, a magnetron 10 for generating a radio frequency wave, an output control unit 9 for controlling driving of the magnetron 10 under a control of the microcomputer 7, and a key input unit 11 for selecting a function desired by a user.

The operation of the thawing device having the above-mentioned construction will now be described.

When the user lays the food 2 to be thawed on the turntable 3 disposed in the heating chamber 1 for thawing the food and manipulates the key input unit 11, the microcomputer 7 determines whether an input key signal generated from the key input unit 11 corresponds to an automatic thawing key signal. Where the generated input key signal does not correspond to the automatic thawing key signal, a function according to the input key signal is carried out. However, where the current input key signal corresponds to the automatic thawing key signal, the microcomputer 7 checks a door condition of the microwave oven. When the door is at its closed state, the microcomputer 7 sends a control signal to the output control unit 9. Under the control of the microcomputer 7, the output control unit 9 controls the magnetron 10 to oscillate, so that the magnetron 10 outputs radio frequency waves. That is, the magnetron 10 is controlled to oscillate for 10 seconds and then stop for 12 seconds repeatedly, as shown in FIG. 3.

Now, the procedure of thawing the food will be described in terms of heating time. At an initial thawing step, the radio frequency wave energy generated by the oscillation of the magnetron 10 permeates the food 2, thereby causing the frozen food 2 to be heated, as shown in A of FIG. 4. As the food 2 is heated, the surface of food 2 is thawed, thereby forming a water film, as shown in B of FIG. 4. At this time, the surface temperature of the food 2 is in excess of 0° C., while the internal temperature of the food 2 is uniformly increased, as compared to the state shown in A of FIG. 4. As the food is further heated, moisture and gas are generated from the water film on the surface of food 12, as shown in C of FIG. 4. The generated moisture and gas are exhausted through the exhaust port 5. At this time, the internal temperature of food 2 is increased to a level approximate to 0° C. On the other hand, the magnetron 10 is controlled to output radio frequency wave energy corresponding to 30 to 50% of its maximum output. This output range may be varied depending on the output grade of the microwave range used.

When the water vapor and gas generated from the food 2 being thawed are exhausted through the exhaust port 5, the gas sensor 6 senses them and generates an electrical signal indicative of the result of its sensing. The microcomputer 7 receives the output signal from the gas sensor 16. When the gas sensor 6 sends a signal having a waveform shown in FIG. 5 to the microcomputer 7, the microcomputer 7 derives the resistance ratio of the output signal of gas sensor 6 by the lapse of time, as shown in FIG. 6. FIG. 6 shows graph illustrating the resistance ratio of the output signal of gas sensor 6 by the lapse of time. In FIG. 6, the line A corresponds to a case where the food 2 is small in amount, while the line B corresponds to a case where the food 2 is large in amount. As shown in FIG. 6, an inflexion phenomenon occurs at the point of time when the frozen food is thawed more or less, namely the point of time t1 or t2. This is because absorption of the radio frequency wave energy is rapidly carried out at the portion of food 2 being thawed, thereby accelerating the generation of water vapor or gas. After one of the lines A and B of FIG. 6 is obtained, the microcomputer 7 senses the inflexion point t1 or t2 each indicative of a melting point of the frozen food 2, from the graph. Where the resistance ratio of the output signal of gas sensor 6 is not less than 1.2, the microcomputer 7 operates to end the thawing operation. On the other hand, where the resistance ratio is less than 1.2, the microcomputer 7 operates to execute additional heating with decreased radio frequency wave energy for a predetermined time T2 in order to secondarily thaw the food 2. Upon secondarily heating the food 2 in the interval T2, the magnetron 10 is controlled to oscillate for 4 seconds and then stop for 18 seconds repeatedly. At this time, the gas sensor 6 generates an output signal having a waveform indicated in the interval T2 of FIG. 5.

At the inflexion point, remarkable inflexion may not occur depending on the condition of the food 2 or the surrounding circumstance. In this case, the microcomputer 7 regards the thawing of food 2 to be completed when the output signal from the gas sensor 6 reaches a predetermined value experimentally given, so as to complete the thawing operation.

In accordance with the prior art, however, where a small amount of food is subjected to a thawing treatment meeting a large amount of food, a phenomenon that the food is partially boiled. On the other hand, where a large amount of food is subjected to a thawing treatment meeting a small amount of food, a phenomenon that the food is insufficiently thawed.

SUMMARY OF THE INVENTION

Therefore, an object of the invention is to provide a method for thawing a food in a microwave oven, capable of effectively thawing a small amount of food.

In accordance with one aspect, the present invention provides a method of automatically thawing a food in a microwave oven, comprising: an initial heating step of initially heating the food for a first predetermined time; an additional heating time calculating step of temporarily stopping the heating of the food for a second predetermined time after completion of the initial heating step, determining whether or not additional heating of the food should be executed, on the basis of a variation of an output signal generated from a gas sensor adapted to sense a water vapor or gas generated from the food during the temporary stop interval, and calculating a time for the additional heating, during the temporary .stop interval; and the step of additionally heating the food for the additional heating time calculated at the additional heating time calculating step, and then completing the thawing of the food.

In accordance with another aspect, the present invention provides a method of automatically thawing a food in a microwave oven, comprising: an initial heating step of initially heating the food for a first predetermined time; an additional heating time calculating step of temporarily stopping the heating of the food for a second predetermined time after completion of the initial heating step, determining whether or not additional heating of the food should be executed, on the basis of a reference time taken for a variation of an output signal generated from a gas sensor adapted to sense a water vapor or gas generated from the food to reach a first predetermined value, and calculating a time for the additional heating on the basis of the reference time; and additionally heating the food for the additional heating time calculated at the additional heating time calculating step, and then completing thawing of the food.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
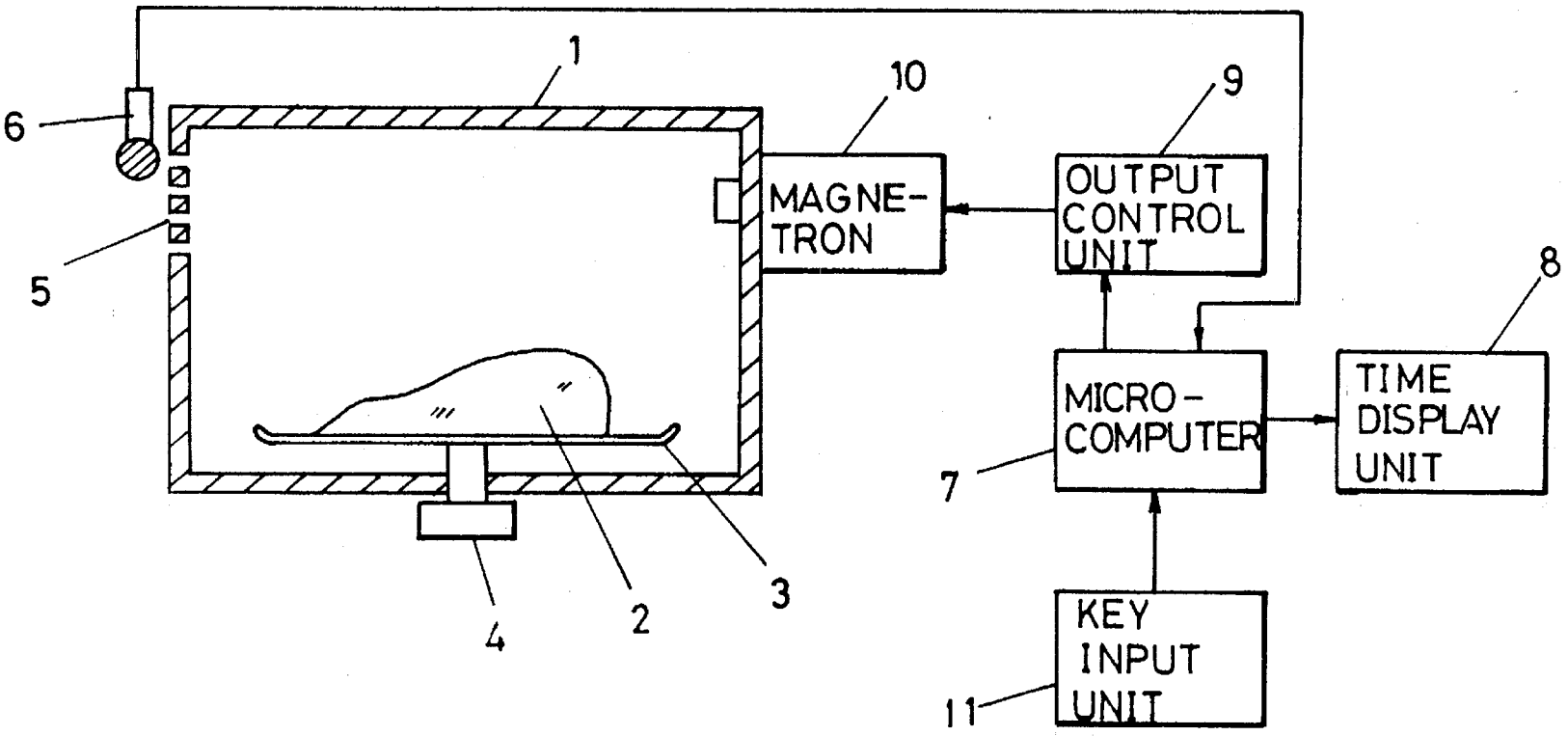
FIG. 1 CONVENTIONAL ART
FIG. 1 is a block diagram of a conventional thawing device equipped in a microwave oven.
Figure 2:
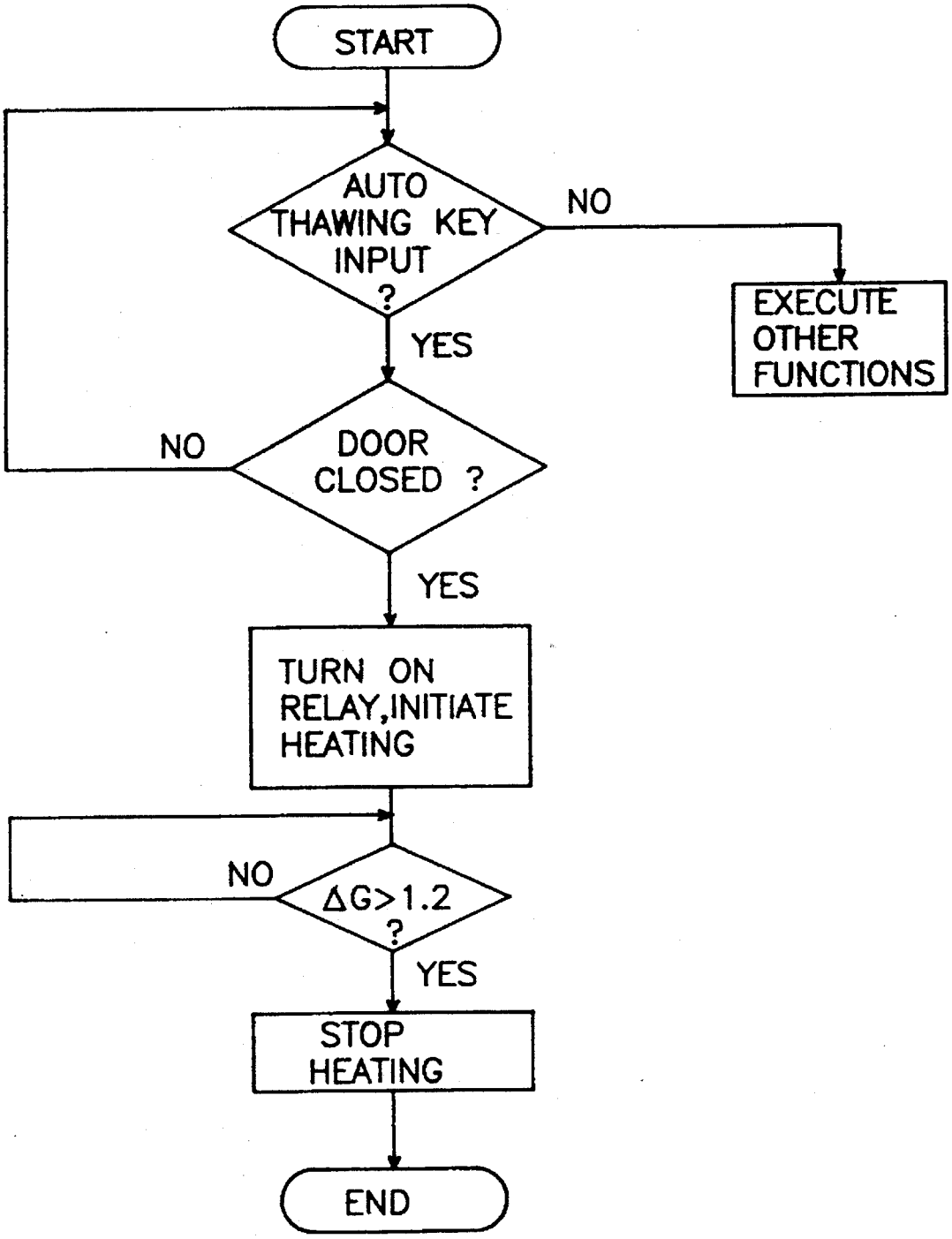
FIG. 2 CONVENTIONAL ART
FIG. 2 is a flow chart illustrating a conventional method for thawing a food using the thawing device shown in FIG. 1.
Figure 3:
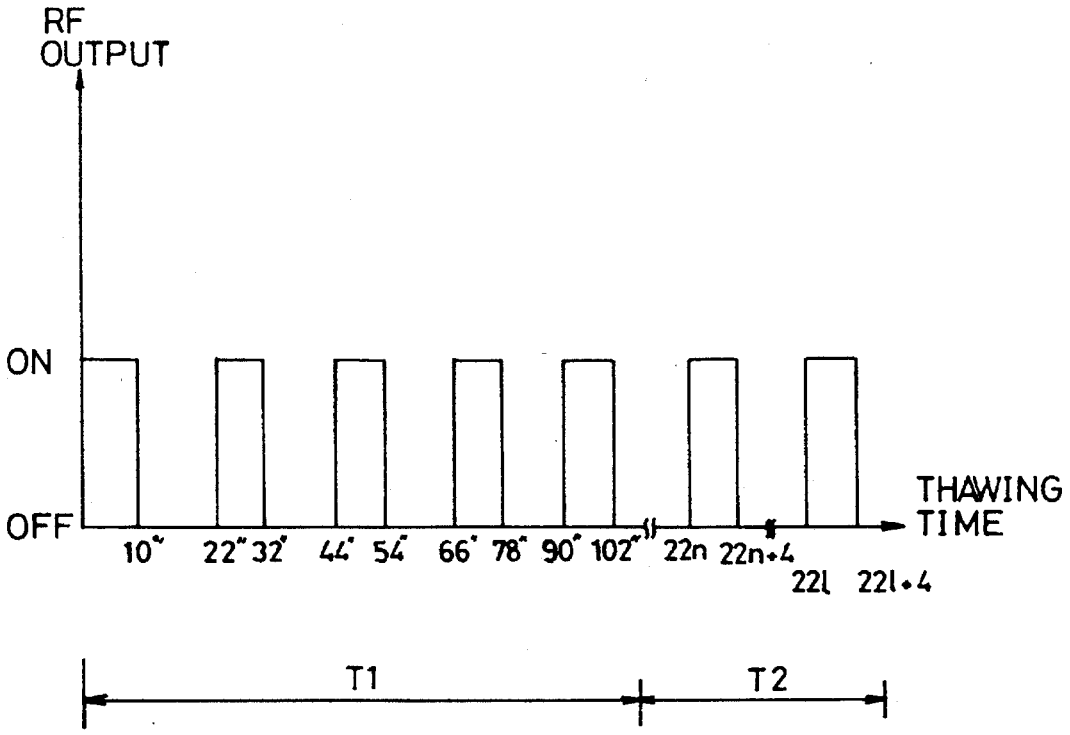
FIG. 3 CONVENTIONAL ART
FIG. 3 is a waveform diagram of an output signal generated from a magnetron equipped in the conventional thawing device of FIG. 1.
Figure 5:
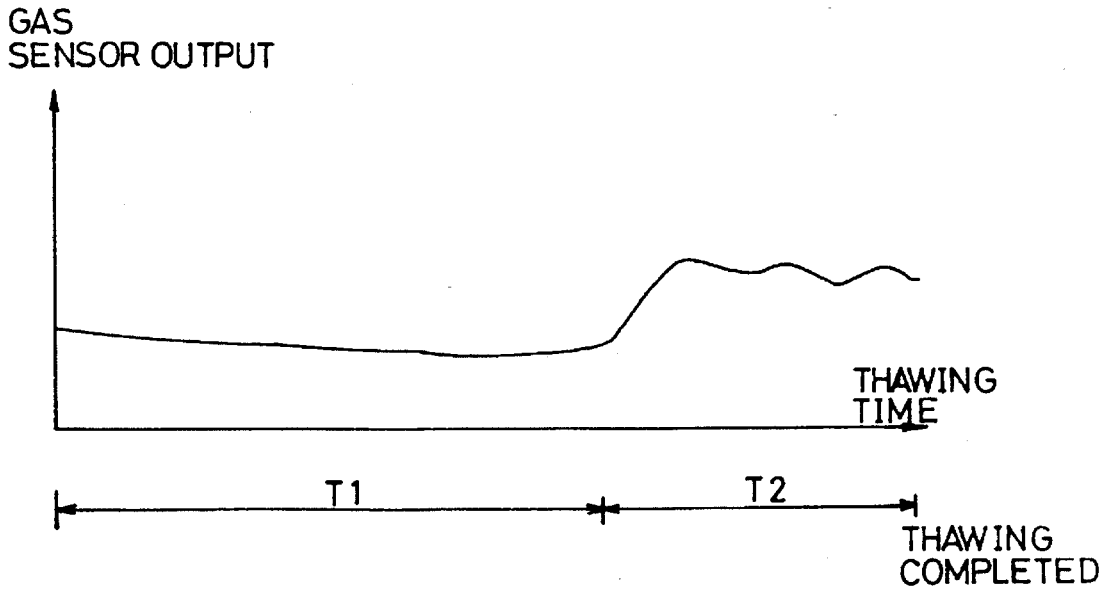
FIG. 5 CONVENTIONAL ART
FIG. 5 is a waveform diagram of an output signal generated from a gas sensor during a thawing operation in accordance with the conventional method.
Figure 4:
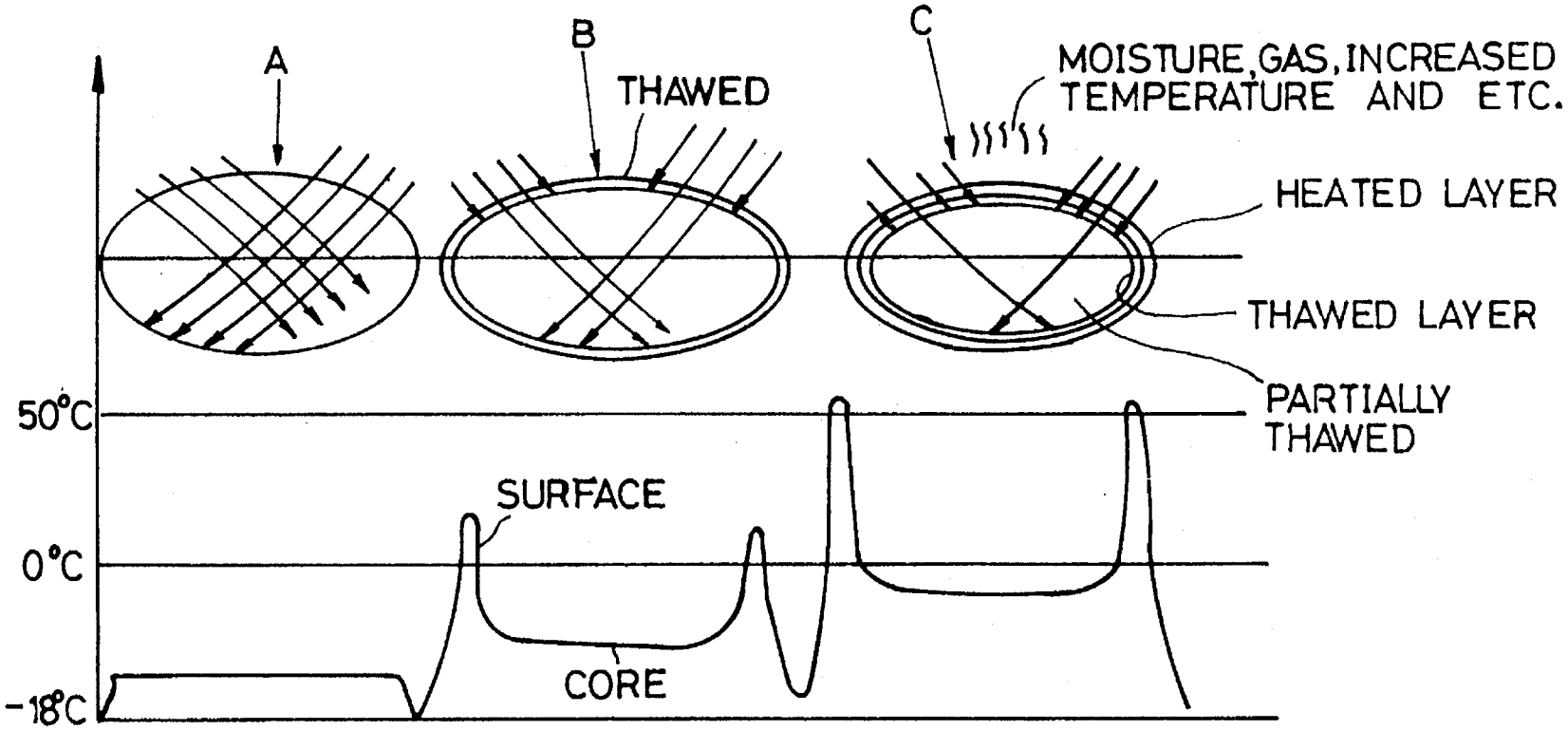
FIG. 4 CONVENTIONAL ART
FIGS. 4 is a schematic view of various conditions of the food subjected to a thawing process carried out in accordance with a conventional thawing method.
Figure 6:
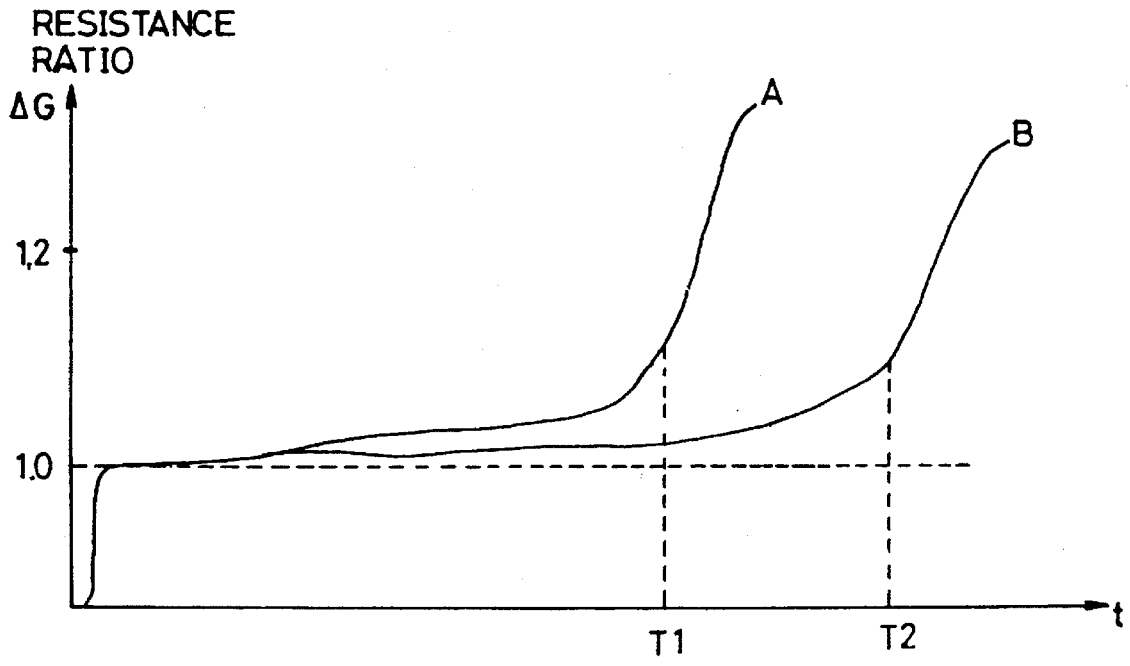
FIG. 6 CONVENTIONAL ART
FIG. 6 is a graph illustrating a resistance ratio of the gas sensor by the lapse of time during the thawing operation in accordance with the conventional method.

The thawing device shown in FIG. 1 is used as a thawing device for carrying out a method for thawing a food in accordance with the present invention. Accordingly, description of the thawing device for carrying out the method of the present invention will be omitted and elements of the thawing device shown in FIG. 1 will be incorporated in the following description.

Figure 7:
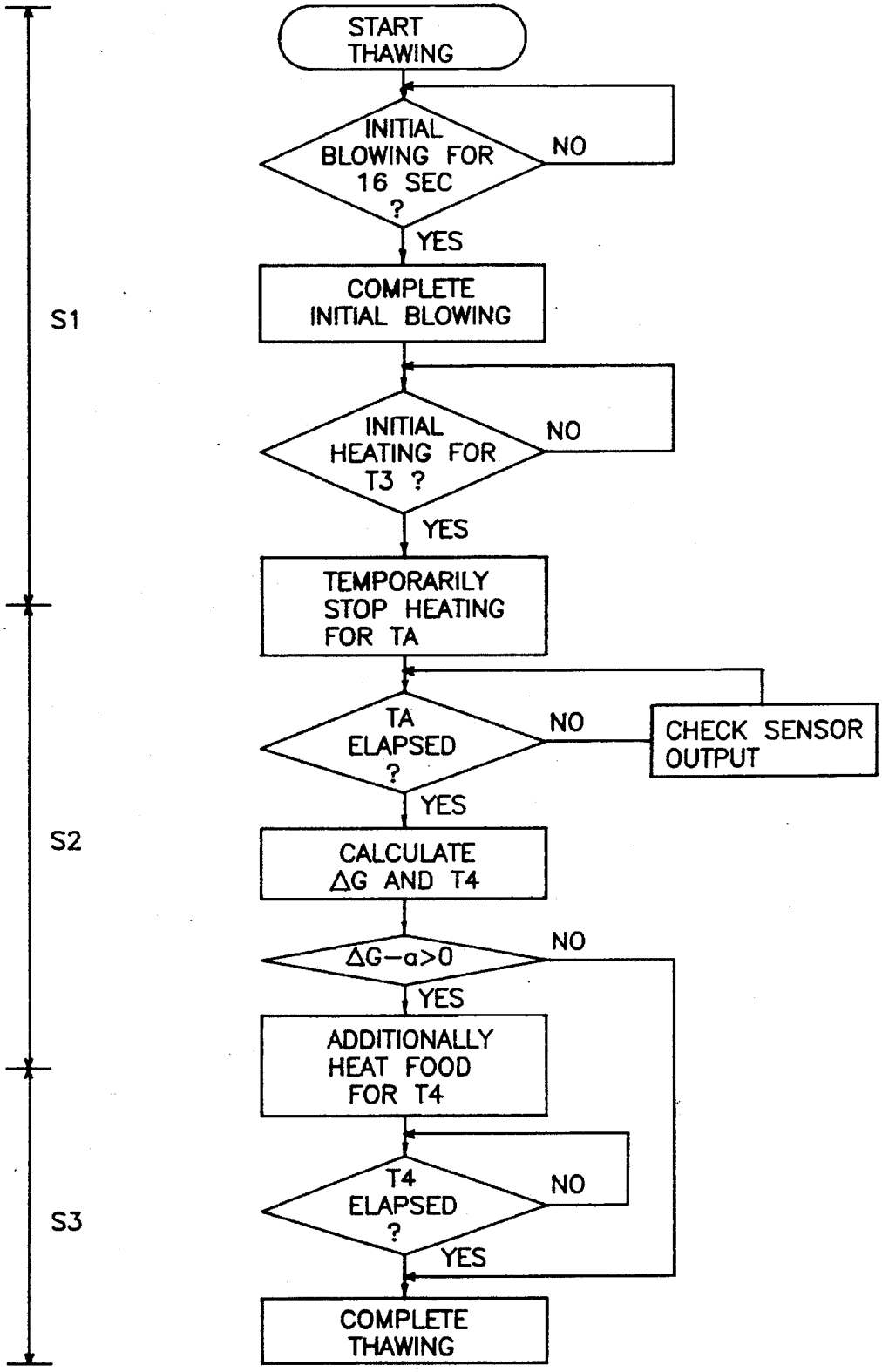
FIG. 7 is a flow chart illustrating a method for thawing a food in accordance with a first embodiment of the present invention.

Referring to FIG. 7, there is illustrated a thawing method in accordance with a first embodiment of the present invention. The thawing method of this embodiment includes an initial heating step S1, an additional heating time calculating step S2 and an additional heating step S3. These steps will be described in detail, in conjunction with FIGS. 7 to 9.

Figure 8:
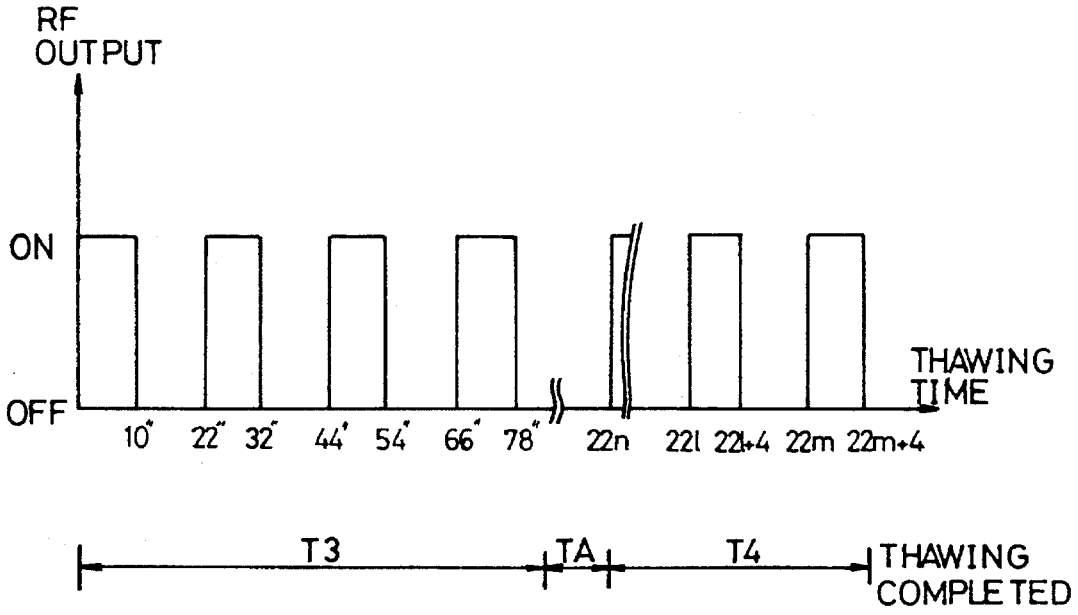
FIG. 8 is a waveform diagram of an output signal generated from the magnetron during a thawing operation in accordance with the method of FIG. 7.

In accordance with this method, at the initial heating step S1, when the user lays the food 2 to be thawed on the turntable 3 disposed in the heating chamber 1 for thawing the food and manipulates the key input unit 11 to generate an automatic thawing key signal, the microcomputer 7 drives a fan (not shown) in response to the automatic thawing key signal so as to achieve an initial thawing operation for a predetermined time of, for example, 16 seconds. After completion of the initial thawing operation, the microcomputer 7 sends a control signal to the output control unit 9. Under the control of the microcomputer 7, the output control unit 9 controls the magnetron 10 to generate radio frequency wave energy for a predetermined time T3, thereby causing the food 2 to be initially heated. In this case, the magnetron 10 is controlled to generate the radio frequency wave energy for 10 seconds and then stop for 12 seconds repeatedly, as shown in FIG. 8. As water vapor and gas generated upon thawing the food 2 are exhausted through the exhaust port 5, the gas sensor 6 senses the exhausted water vapor and gas and generates an electrical signal indicative of the result of the sensing. The generated electrical signal is sent to the microcomputer 7. The output signal of the gas sensor 6 has a waveform indicated in the interval T3 of FIG. 9.

Thereafter, the microcomputer 7 operates to stop the heating operation for a predetermined temporary stop interval TA of, for example, about one minute after completion of the initial heating step S1, at the additional heating time calculating step S2. Under this condition, the microcomputer 7 checks a variation $\Delta G$ of the output signal generated from the gas sensor 6 for the temporary stop interval TA, so as to determine whether the food 2 has to be additionally heated and the condition of the additional heating if the food 2 has to be additionally heated. Accordingly, the microcomputer 7 calculates an additional heating time T4 in accordance with the following equation (1):

$$T4=(\Delta G-a)\times b \ (second) \qquad (1)$$

where, "a" and "b" are constants variable depending on the size of the heating chamber and experimentally given.

When "$\Delta G-a$" in the equation (1) is not greater than "0", it is regarded as "0" and the additional heating time T4 is "0". In this case, the thawing of the food 2 is completed only by the initial heating for the predetermined time T3 without any additional heating. This case corresponds to the case where the food 2 is small in amount. Where "$\Delta G-a$" in the equation (1) is greater than "0", the additional heating time T4 is determined using the equation (1). This case corresponds to the case where the food 2 is large in amount.

Thereafter, the additional heating step S3 is executed. That is, the microcomputer 7 displays the additional heating time T4 calculated at the additional heating time calculating step S2 on the time display unit 8. The microcomputer 7 also controls the output control unit 9 so that the magnetron 10 operates to additionally heat the food 2 for the additional heating time T4. After completion of the additional heating operation, the microcomputer 7 completes the thawing operation.

Figure 9:
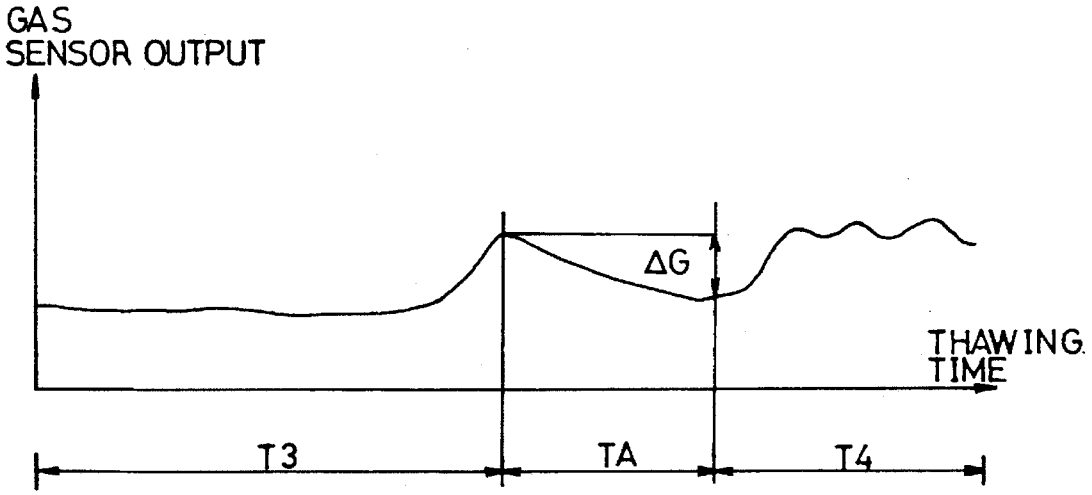
FIG. 9 is a waveform diagram of an output signal generated from the gas sensor during the thawing operation in accordance with the method of FIG. 7.

FIGS. 8 and 9 are waveform diagrams of output signals of the magnetron 10 and gas sensor 6 for the temporary stop interval TA and additional heating interval T4, respectively.

Figure 10:
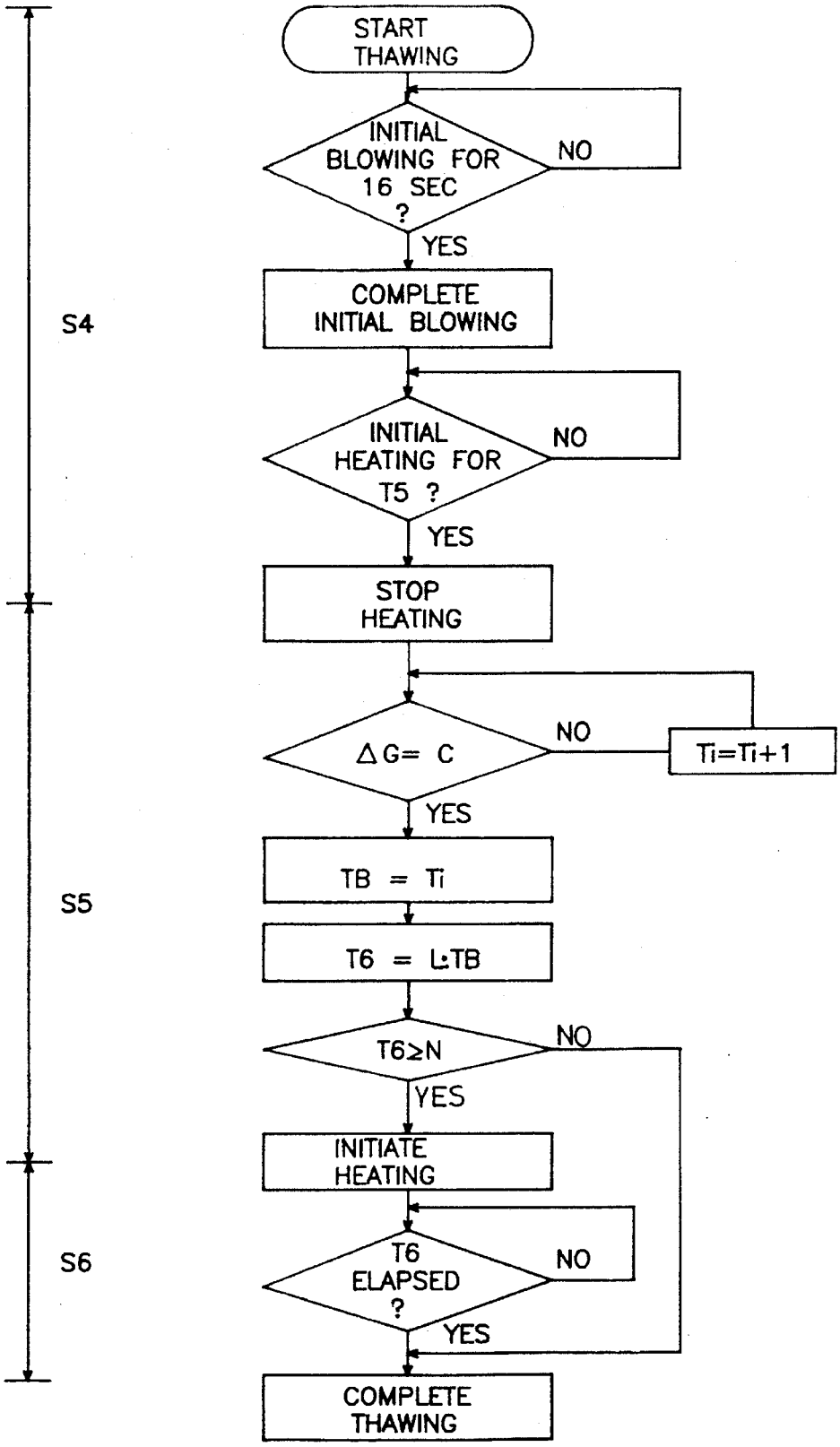
FIG. 10 is a flow chart illustrating a method for thawing a food in accordance with a second embodiment of the present invention.

Referring to FIG. 10, there is illustrated a thawing method in accordance with a second embodiment of the present invention. The thawing method of this embodiment includes an initial heating step S4, an additional heating time calculating step S5 and an additional heating step S6, similar to the thawing method of the first embodiment. These steps will be described in detail, in conjunction with FIG. 10.

In accordance with this method, at the initial heating step S4, the food 2 to be thawed is initially heated for a predetermined time T5 in the same manner as in the initial heating step S1 of the first embodiment.

Thereafter, the additional heating time calculating step S5 is executed. At the additional heating time calculating step S5, the heating of food 2 is temporarily stopped. During the time when the heating of food 2 is temporarily stopped, a time TB taken for a variation ΔG of the signal generated from the gas sensor 6 to reach a predetermined value C is measured. That is, the microcomputer 7 measures a time Ti taken for the variation ΔG of the output signal of the gas sensor 6 to correspond to the predetermined value C. The microcomputer 7 takes the measured time Ti as the temporary stop time TB. Subsequently, the microcomputer 7 multiplies the temporary stop time TB by a constant L experimentally given, thereby obtaining a value T6. Thereafter, the microcomputer 7 compares the value T6 with a predetermined value N. When the value T6 is less than the predetermined value N, the thawing operation is completed without any additional heating. That is, the food 2 is thawed only by the initial heating for the time T5. On the other hand, when the value T6 is greater than or equal to the predetermined value N, the value T6 is regarded as the additional heating time. In this case, the additional heating step S6 is executed.

At the additional heating step S6, the food 2 is additionally heated for the calculated additional heating time T6. After completion of the additional heating step S6, the thawing operation is completed.

As apparent from the above description, the present invention provides a method for thawing a food in a microwave oven, involving the steps of determining whether the food needs to be additionally heated in a temporary stop interval after initial heating of the food and calculating an additional heating time, thereby preventing the food from being partially boiled where the food is small in amount and, thus, achieving an optimum thawing.

Although the preferred embodiments of the invention have been disclosed for illustrative purposes, those skilled in the art will appreciate that various modifications, additions and substitutions are possible, without departing from the scope and spirit of the invention as disclosed in the accompanying claims. For example, the gas sensor 6 as means for sensing the degree of thawing may be replaced by a humidity sensor or a temperature sensor.

What is claimed is:

1. A method of automatically thawing a food in a microwave oven having an automatic thawing function, comprising the steps of:

selecting the automatic thawing function of the microwave oven;

generating an automatic thawing signal upon selection of the automatic thawing function of the microwave oven;

initially heating the food for a first predetermined time according to the automatic thawing signal;

temporarily stopping the initial heating of the food for a second predetermined time after completion of the initial heating step;

determining whether or not an additional heating of the food should be executed, on the basis of a variation of an output signal generated from a gas sensor adapted to sense a water vapor or gas generated from the food, during the second predetermined time;

calculating an additional heating time for the additional heating during the second predetermined time;

displaying the calculated additional heating time; and additionally heating the food for the additional heating time calculated at the calculating step so as to complete the automatic thawing of the food.

2. A method in accordance with claim 1, wherein said determining step comprises, checking the variation of the output signal from the gas sensor for a third predetermined time, and said step of calculating an additional heating time comprises, calculating a difference between the checked variation of the output signal from the gas sensor and an experimentally determined first constant; and applying no additional heat to the food when the calculated difference is less than or equal to zero, while multiplying the calculated difference by an experimentally determined second constant when the calculated difference is greater than zero, thereby determining the additional heating time.

3. A method in accordance with claim 2, wherein said second predetermined time is approximately one minute.

4. A method of automatically thawing a food in a microwave oven having an automatic thawing function, comprising the steps of:

selecting the automatic thawing function of the microwave oven;

generating an automatic thawing signal upon selection of the automatic thawing function;

initially heating the food for a first predetermined time according to the automatic thawing signal;

temporarily stopping the initial heating of the food for a second predetermined time after completion of the initial heating step;

determining during the second predetermined time whether or not an additional heating of the food should be executed, on the basis of a reference time taken for a variation of an output signal generated from a gas sensor adapted to sense a water vapor or gas generated from the food to reach a first predetermined value;

calculating during the second predetermined time an additional heating time for the additional heating of the food on the basis of the reference time;

displaying the calculated additional heating time; and additionally heating the food for the additional heating time calculated at the additional heating time calculating step so as to complete the automatic thawing of the food.

5. A method in accordance with claim 4, Wherein said determining step comprises, measuring a time taken for the variation of the output signal from the gas sensor to reach the first predetermined value, and said step of calculating an additional heating time comprises, multiplying the measured time by a first constant; and applying no additional heat to the food when the resultant value obtained at the multiplying step is less than a second predetermined value, while determining the resultant value obtained at the multiplying step as the additional heating time when the resultant value is greater than or equal to the second predetermined value.

6. A method in accordance with claim 5, wherein said second predetermined time is approximately one minute.

* * * * *